US005865684A

United States Patent [19]

Herber

[11] Patent Number: 5,865,684

[45] Date of Patent: Feb. 2, 1999

[54] MULTI-USE GOLF CLUB

[75] Inventor: Paul J. Herber, Vista, Calif.

[73] Assignee: La Jolla Club, Inc., Vista, Calif.

[21] Appl. No.: 846,652

[22] Filed: May 1, 1997

[51] Int. Cl.[6] ..... A63B 53/00; A63B 53/08

[52] U.S. Cl. ..... 473/201; 473/287; 473/300; 473/319; 274/DIG. 7

[58] Field of Search ..... 473/316–323, 473/300–303, 201, 287; 273/DIG. 7

[56] References Cited

U.S. PATENT DOCUMENTS

| | | | |
|---|---|---|---|
| Re. 19,731 | 10/1935 | Hackett | 473/316 |
| 1,457,528 | 6/1923 | Jordan | 473/322 |
| 1,486,572 | 3/1924 | Forsyth | 473/322 |
| 1,587,082 | 6/1926 | Mattern | 473/302 |
| 2,050,554 | 8/1936 | Barnhart | 473/323 |
| 2,809,144 | 10/1957 | Grimes | 473/320 |
| 3,840,231 | 10/1974 | Moore | 473/245 |
| 4,431,187 | 2/1984 | Rumble | 473/323 |
| 5,018,735 | 5/1991 | Meredith | 473/318 |
| 5,295,686 | 3/1994 | Lundberg | 473/291 |
| 5,308,062 | 5/1994 | Hogan | 473/316 |

*Primary Examiner*—Sebastiano Passaniti
*Assistant Examiner*—Stephen L. Blau
*Attorney, Agent, or Firm*—George J. Netter

[57] ABSTRACT

The present invention provides a multi-use golf club which allows a user to select a long or short shot without changing the dynamics of the user's golf swing. This is accomplished with a hand grip having at least two hand grip position designations located thereon, each hand grip designation defining a different set of golf club characteristics. During use, characteristics associated with a long shot are exhibited when the user's grip is positioned adjacent one hand grip designation, and characteristics associated with a short shot are exhibited when the users's grip is positioned adjacent the other hand grip designation. Additionally, the present invention implements a variable diameter golf club shaft which is uniquely calibrated for users having reduced club head speed swings such as junior and senior golfers. The solid core shaft of the present invention has a preselected taper portion and flex point adjustably located intermediate the top and bottom ends of the shaft. A wide range of shaft flexes are available with relatively short shaft lengths while maintaining an acceptable strength to flex ratio for use as a golf club.

5 Claims, 4 Drawing Sheets

MULTI-USE GOLF CLUB

FIELD OF THE INVENTION

The present invention pertains generally to golf clubs. More particularly, the present invention provides a multi-use golf club which allows a user to select a long or short shot without changing the dynamics of the user's golf swing. Additionally, the present invention implements a golf club shaft which is uniquely calibrated for users having reduced club head speed swings such as junior and senior golfers.

BACKGROUND OF THE INVENTION

During training, new golfers are taught the concept of "clubbing" whereby they learn the technique of choosing which club to swing in order to hit the golf ball a desired distance. Since a standard set of golf clubs consists of 14 clubs, choosing the appropriate club from the set to match the desired shot can be overwhelming and confusing, resulting in frustration for the beginning golfer. Training would be greatly improved if the number of clubs were reduced without adversely limiting the number of shot options typically available to a golfer with a standard set of clubs.

Alternatively, it is the desire of more experienced golfers to increase the shot options available to them by increasing the number of clubs rather than reducing or limiting them. However, according to regulations adopted by the United States Golf Association, there is a limit to the number of clubs which may be used during the play of golf. Presently, if a golfer wants to change or vary the performance of a golf club, such as the golf ball trajectory angle or the travel distance of the golf ball, the golfer must either adjust the dynamics of his or her swing, such as the energy applied to the swing, or select a different club having the desired set of performance characteristics. Greater options would be available to the experienced golfer if each golf club provided multiple shot options without changing the user's swing mechanics.

Finally, as is commonly known, the game of golf is physically wearing since it necessarily requires the player to transport a significant number of bulky clubs across a large area of land in order to adequately play a round of golf. In this respect, a single golf club which performs the function of two typical golf clubs would be of great value in reducing fatigue.

In the past, very little has been done on the proper fitting and design of golf clubs for users having reduced swing speeds such as junior and senior golfers and the like. It is well known that the design characteristics of the golf club shaft is one of the most influential factors in total golf club design. Despite this well known fact, current technology is lacking in the area of golf club shaft design for user's with below average swing speeds.

Presently, junior's between the ages of 5 and 18 are fitted for golf clubs by following well known guidelines and factors which are intended to provide a basis for determining the proper shaft length and flex of the golf club. More specifically, the length of the golf club shaft is primarily based upon the approximate height of the user. Consequently, golf club shafts designed for juniors are much shorter than standard clubs designed for the average adult.

The flexibility of the golf club shaft or shaft flex is primarily based upon the user's strength ability and speed with which the golf club head is normally swung. For example, the less strength or slower speed in which a golf club is swung, the more shaft flex is required for proper fitting. Typically, juniors of relatively young ages and seniors of relatively old ages do not have the normal strength of an average adult, and thus have reduced swing speeds which must be considered when designing the golf club shaft.

There is a direct relationship between shaft flex and the length of the golf shaft. For example, a given shaft flex tends to feel more flexible as the club is lengthened and more stiff as the club is shortened. Although a large number of different shaft types, flexes and material are available, this tension between shaft length and shaft flex has been a complicated problem for designers trying to fit golf clubs for user's having reduced swing speeds such as junior and senior golfers.

More particularly, a golfer playing with a club that has too stiff a shaft flex may compensate for or experience lower than normal ball trajectory, un-solid feeling at impact on all but the exact dead center hits, a "boardy" feeling, consistently pushing the ball to the right or slicing, and loss of distance. On the other hand, a golfer playing with a club which has too flexible a shaft may compensate for or experience higher than normal ball trajectory, poor directional control, excessive hooking resulting from the face closing before impact, whippy feeling, and loss of distance.

Some manufacturers of golf clubs have cut adult clubs down in length for use by juniors resulting in an incorrect shaft flex. Other manufacturers have tapered or reduced the diameter of the shaft so as to create a more flexible golf club, and as a result of the materials used, have been unsuccessful. More specifically, shafts made with relatively small diameters exhibit unacceptably low strength characteristics and are most likely to break during use when constructed with common shaft materials, such as steel or graphite. This required shaft manufacturers who varied diameters to produce "fat" shafts for proper strength to flex ratio, but these bulky shafts are decidedly stiff for shorter lengths and do not provide the feel most players want.

In addition to the low strength to flex ratio, current shaft designs which implement small diameters require that the core diameter of the hand grip be adjusted to fit the small diameter by the use of underpinnings, such as wood or excess two sided grip tape. These necessary adjustment devices add more weight to the golf club resulting in imbalances, increases in hand grip slippage resulting in inconsistency in golf shots and reduced safety for the golfer and the golfer's playing companions, and increases in overall manufacturing tolerances.

Currently, golf shaft designs using the standard technologies and materials cannot provide both the strength and the flexibility and are either significantly too stiff to be used as an adequate golf shaft for user's with reduced speed swings or have very low strength tolerances and are prone to breaking.

SUMMARY OF THE INVENTION

It is therefore a primary object of the present invention to provide a single golf club which effectively combines the characteristics of two typical separately numbered golf clubs thereby simplifying the club selection process for beginning golfers, reducing the amount of equipment necessary to properly play a round of golf, and increasing the number of shot options currently available to experienced golfers while remaining within the required rule limiting the number of golf clubs used during the play of golf.

It is another object of the present invention to provide a golf club which allows the user to select the desired travel distance of a golf ball without changing the dynamics of the user's normal or typical golf swing.

It is yet another object of the present invention to provide a golf club shaft which is particularly calibrated for users having reduced club head swing speeds such as junior and senior golfers.

It is yet a further object of the present invention to provide a golf club and method for increasing the range of shaft flexes available for relatively short shaft lengths while maintaining an acceptable shaft strength to flex ratio.

It is also the objects of the present invention to provide a golf club which exhibits consistent golf shot results, efficiently absorbs unwanted vibrations and shocks created by the impact of the golf club head hitting the golf ball, and increases the safety of the golfer and the golfer's playing companions.

These and other objects are achieved with a golf club consisting of the following three main components; a club head, a shaft, and a handgrip. A standard club head for striking a golf ball is attached to the bottom end of the shaft and a specially designed hand grip is attached to the shaft's top end. The hand grip of the present invention has at least two hand grip position designations located thereon, both designations are preferably positioned within 2 to 4 inches from one another.

As a result of the user's normal or typical golf swing resulting in a successful shot, the travel distance of the golf ball resulting from the user's swing when the user's grip is positioned adjacent one hand grip designation is on the average of 2 to 5 yards shorter than the travel distance resulting from the user's hand grip at the other designation.

It is well known in the sport of golf that any given club within a golf club set is assigned a particular club number which defines certain characteristics or specifications unique to the golf club, such as expected shot distance, shaft length, club head speed, and golf ball trajectory/launch angle. In accordance therewith, the head of the present invention may have a first and second club number or designation located thereon. The first club number on the club head corresponds to a first set of golf club characteristics and the second club number corresponds to a second set of characteristics. During use, the first set of characteristics is exhibited when the user's grip is positioned adjacent one hand grip designation, and the second set of characteristics is exhibited when the user's grip is positioned adjacent the other hand grip designation.

The present invention is particularly calibrated for users such as junior and senior golfers who inherently exhibit reduced club head swing speeds. More specifically, the shaft of the present invention has a preselected taper portion and flex point located intermediate the top and bottom ends of the shaft. The shaft is preferably constructed of a single piece of solid core fiberglass having an acceptable shaft strength to flex ratio for use as a golf club.

The taper portion begins and ends at a first and second location respectively. The diameters of the shaft at the first and second locations, defined herein as a first and second diameter, are relatively small and preferably do not exceed 11 mm. The relative length and variation in diameter of the taper portion as well as the position and diameter at the first and second locations of the shaft are variables which increase the range of shaft flexes available for relatively short shaft length and/or user's who exhibit reduced club head swing speeds.

Since the diameter of the shaft is relatively small, the hand grip of the present invention is specially designed with a core diameter of approximately 0.335 of an inch to properly fit the shaft without underpinnings or further adjustments.

The flex point is another variable which determines shaft flex and may be located on the shaft either closer or further from the top end than the bottom end. The location of the flex point is calibrated to fit the typical swing speed and height of the golfer.

The present invention also pertains to a method of calibrating a golf club for a user having a swing speed of 60 mph or less. The first step in the method includes the step of providing a strong yet flexible cylindrical shaft material such as solid core fiberglass. This step is followed by the step of determining the length of the shaft which is a proportional relationship to the measured height of the user. The next step includes selecting the particular diameter variation and length of a taper portion located intermediate the first and second ends of the shaft based upon the relative club head swing speed of the user. The method continues with the step of connecting a head for striking a golf ball to the bottom end of the shaft and attaching a hand grip to the top end of the shaft, the hand grip having a short and long shot hand grip designation respectively.

Further detail regarding the multi-use golf club in accordance with the present invention may be had with reference to the detailed description which is provided below, taken in conjunction with the following illustrations.

DETAILED DESCRIPTION OF THE PREFERRED EMBODIMENT

Figure 1:
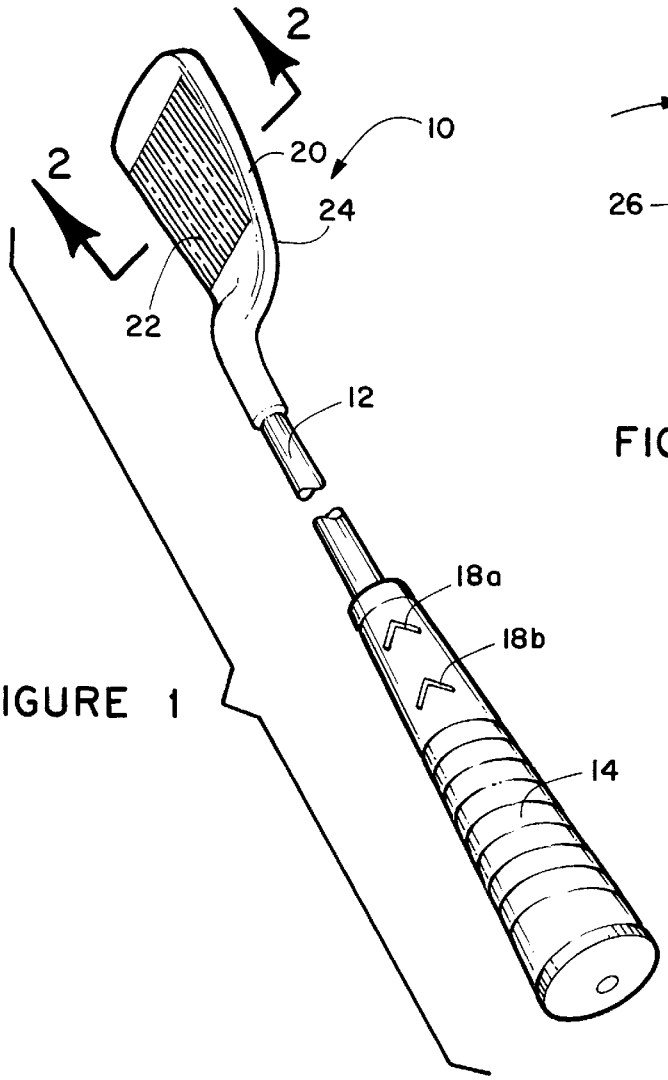
FIG. 1 is an overall perspective view of the present invention assembled with a shaft, club head and hand grip.

Initially referring to FIG. 1, a multi-use golf club 10 of the present invention is illustrated. The golf club 10 has three main components, namely a shaft 12, a hand grip 14, and a club head 20. The shaft 12 may be constructed of any well known flexible material having an acceptable shaft strength to flex ratio for use as a golf club. In the preferred embodiment, shaft 12 is a single piece of solid core fiberglass such as thermoset "E" type fiberglass.

The hand grip 14 is connected to the top end of the shaft 12 as shown in FIG. 1. The hand grip 14 of the present invention has at least two hand grip position designations

18*a,b* selectively positioned thereon. By way of example rather than limitation, one of the designations may be defined as a "short shot" hand grip designation 18*a* and may be located on the hand grip a given distance from the top end of the shaft. Another designation may defined as a "long shot" hand grip designation 18*b* and may be located a distance which is closer to the top end of the shaft than the other "short shot" designation 18*a*.

The club head 20, having a club face 22 and backside 24, is connected to the end opposing the hand grip 14 or bottom end on shaft 12. Club head 20 may be any type or size of standard golf club head, such as a wood or an iron, and may be formed from a variety of well known materials such as metal, wood, or graphite.

Figure 2:
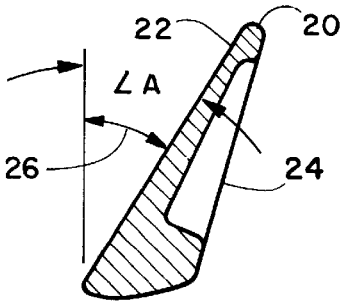
FIG. 2 is a cross sectional view of the golf club head of the present invention illustrating a typical loft angle.

FIG. 2 is a cross-sectional view of an iron club head 20 taken at lines 2—2 of FIG. 1. As shown, club head 20 has a loft angle 26 which may be any typical degree angle commonly found on standard golf club heads.

It is typical in the industry for a golf club to be marked with a "club number" designation. The club number designation communicates to the user a particular set of characteristics that can be expected during use of that particular club. Shot distance, shaft length, club head speed, and golf ball trajectory are all characteristics of a particular golf club. By way of example rather than limitation, a number 1 golf club defines a long shot, while a number 3 defines a short shot. Although the numbering system is somewhat of a standard, each manufacturer of golf clubs associates a unique set of characteristics with each number based upon proprietary golf club designs.

Figure 3:
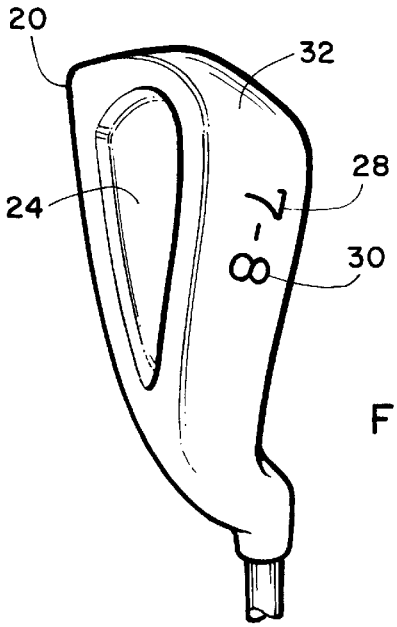
FIG. 3 is an exploded perspective view of the golf club head of the present invention illustrating multiple club number designations corresponding to multiple club sizes and characteristics.

Referring now to FIG. 3, the club head 20 of the present invention has at least two club number designations 28, 30 formed, marked or engraved in the outer surface 32 of club head 20. As previously mentioned, one club number designation identifies a certain set of characteristics while the other club number designation identifies a different set of characteristics. The user can select a desired set of characteristics by selecting a particular hand grip designation 18*a*, 18*b*, as will be discussed in further detail below.

Figure 4:
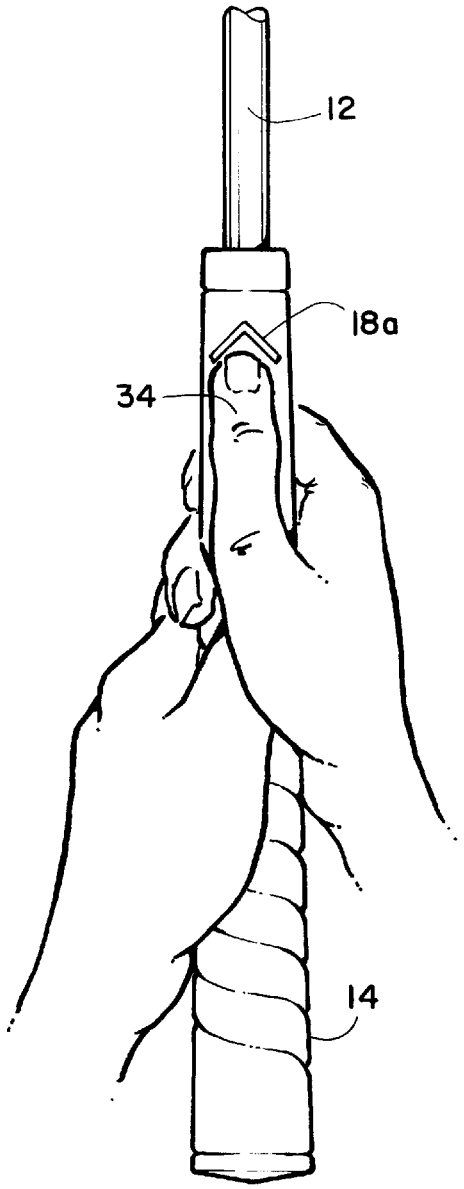
FIG. 4 is an exploded perspective view of the hand grip of the present invention showing the user's thumb positioned adjacent the short shot designation on the hand grip.
Figure 5:
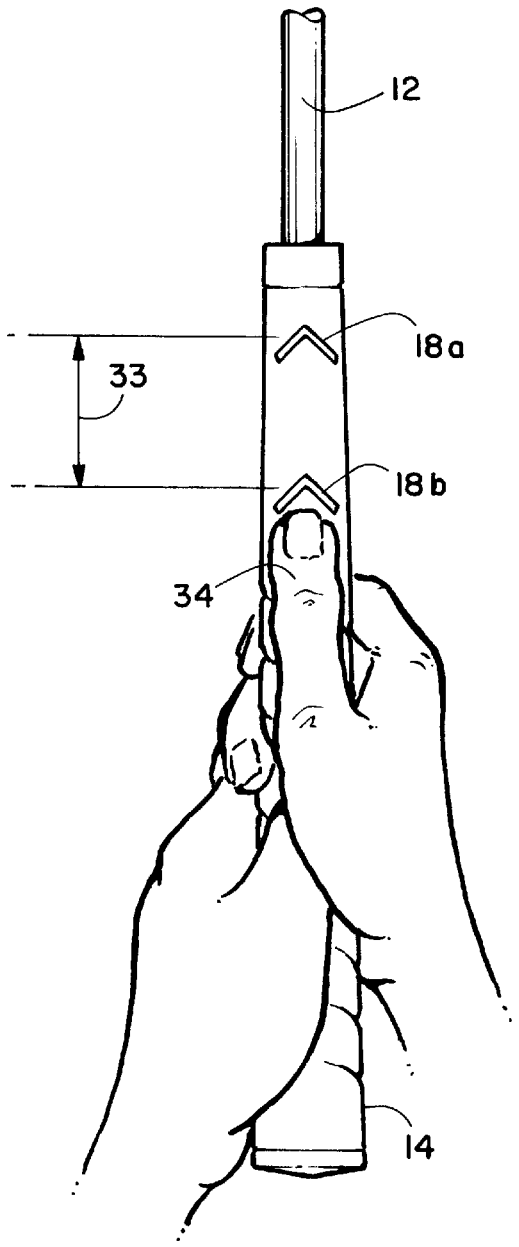
FIG. 5 is an exploded perspective view of the hand grip of the present invention showing the user's thumb positioned adjacent the long shot designation on the hand grip.

The placement of a users hand on the hand grip designations 18*a*, 18*b* on hand grip 14 is best illustrated in FIGS. 4 and 5. As shown, hand grip designations 18*a*, 18*b* are spaced a distance 33 from one another. Although the present invention contemplates a distance 33 of various lengths, in the preferred embodiment, distance 33 is 2 inches in length. When the user desires to hit the golf ball a relatively "short" distance, the user places his or her thumb 34 on the short shot hand grip designation 18*a* and grips the hand grip 14 as shown in FIG. 4. Alternatively, when the user desires to hit the golf ball a relatively "long" distance, the user places his or her thumb 34 on the long shot hand grip designation 18*b* and grips the hand grip 14 as shown in FIG. 5.

Figure 6:
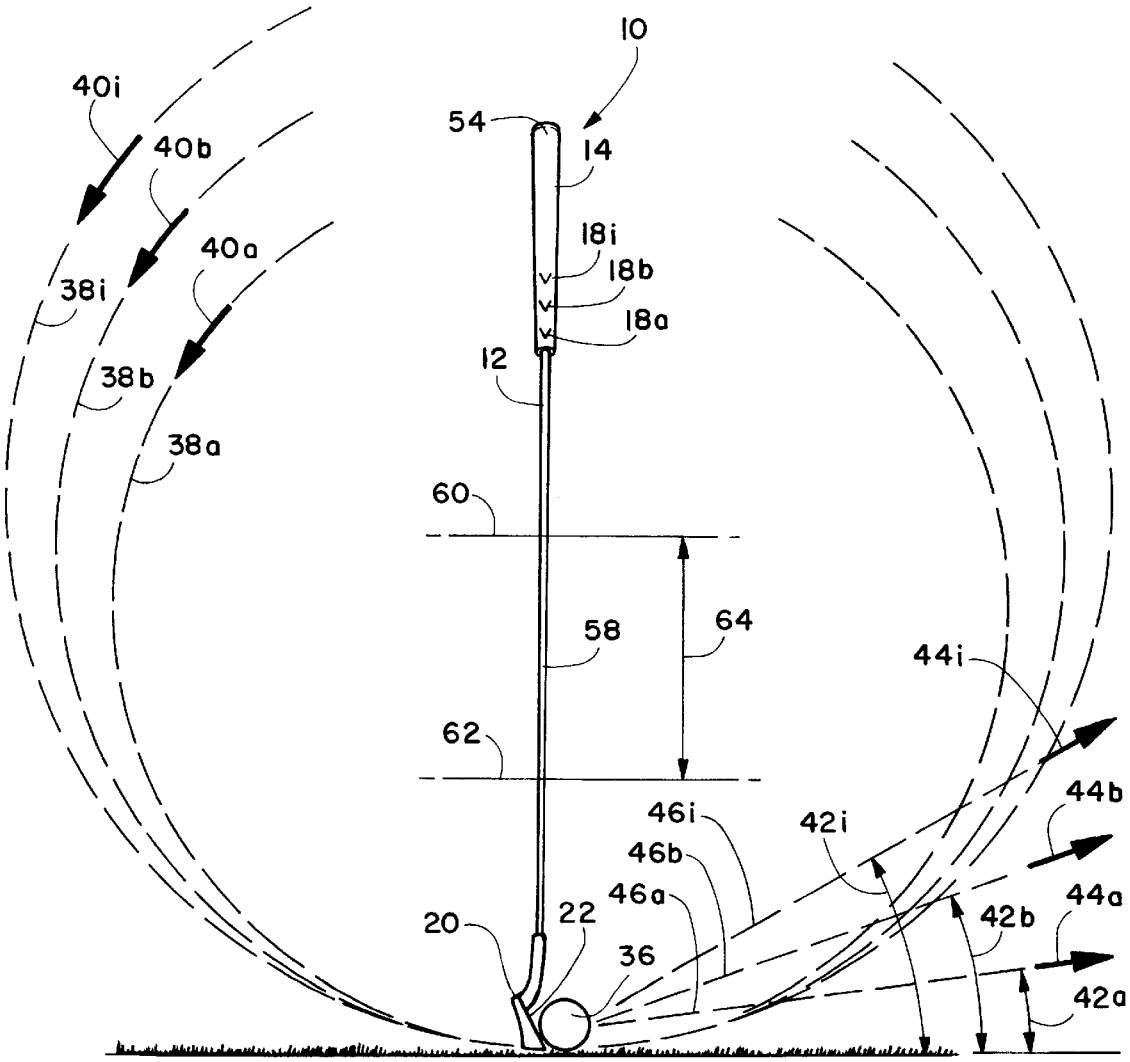
FIG. 6 is a side view comparing club head movement and corresponding golf ball trajectory based upon variation in hand grip position and shaft design as a result of a given user's swing.

Now referring to FIG. 6, a comparison of different hand grip position designations 18*a–i* and the corresponding golf club performance characteristics as a result of a user's typical golf swing is shown. More particularly, the performance characteristics observed include the swing arc 38*a–i* of golf club head movement, club head speed 40*a–i*, golf ball trajectory 44*a–i*, travel distance 46*a–i* and launch angle 42*a–i* of golf ball 36 after impact with the club face 22 of club head 20. The speed is measured by measuring the speed of the golf club head 20 during impact of the club face 22 with the golf ball 36. Upon impact, the golf ball 36 is propelled forward and into the air at a launch angle 42*a–i*, wherein the golf ball 36 travels a distance 46*a–i*.

As a result of the user's normal or typical golf swing resulting in a successful shot, the performance characteristics of the golf club 10 when the user's grip is positioned adjacent the short shot hand grip designation 18*a* includes swing arc 38*a* of golf club head movement, club head speed 40*a*, golf ball trajectory 44*a*, launch angle 42*a*, and travel distance 46*a* of golf ball 36 after impact with the club face 22 of club head 20.

Alternatively, the performance characteristics of the golf club 10 when the user's thumb is positioned adjacent the long shot hand grip designation 18*b* includes a larger swing arc 38*b* of golf club head movement, faster club head speed 40*b*, higher golf ball trajectory 44*b*, larger launch angle 42*b*, and greater travel distance 46*b* of the golf ball 36 after impact with the club face 22 of club head 20.

Similarly, the performance characteristics of the golf club 10 when the user's thumb is positioned adjacent yet another hand grip designation 18*i* includes an even larger swing arc 38*i* of golf club head movement, an even faster club head speed 40*i*, an even higher golf ball trajectory 44*i*, an even larger launch angle 42*i*, and an even greater travel distance 46*i* of the golf ball 36 after impact with the club face 22 of club head 20.

As mentioned above, the distance 33 between each designation 18*a–i* is approximately 2 inches. For slower club head speeds of between 35 to 60 miles per hour, this results in a speed differential between club head speeds 40*a–i* of between 2 to 5 miles per hour. For example, the club head speed 40*b* would be between 2 and 5 miles per hour faster than club head speed 40*a*. Similarly, the distance differential between travel distances 46*a–i* at a club head speed of between 35 to 60 miles per hour is between 2 to 5 yards. It is to be understood that these values will change based upon the normal club head speed of the user.

An essential component of the design of golf club 10 of the present invention is the shaft 12 having a top and bottom ends 54, 56, respectively. The shaft 12 of the present invention is particularly calibrated for users such as junior and senior golfers who inherently exhibit reduced club head swing speeds. Although shafts of various lengths are contemplated by the present invention, best results are accomplished with shafts which do not exceed 40 inches in length and swing speeds which do not exceed 60 mph.

As shown in FIG. 6, a pre-selected portion of the shaft 12 is a diameter taper 58 which is located intermediate the top and bottom ends 54, 56. The taper portion 58 begins at a first location 60 on the shaft 12 and ends at a second location 62 on the shaft 12. The relative length 64 of the taper portion 58 and the relative position of the first and second locations 60, 62 are variables which increase the range of shaft flexes available for relatively short shaft lengths and/or user's who exhibit reduced club head swing speeds. In the preferred embodiment, the first location 60 is between 20 and 28 inches from the top end 54 of the shaft 12, and the second location 62 is between 23 and 31 inches from the top end 54 of the shaft 12. However, the present invention contemplates that the length 64 of the taper portion 58 could extend from the top end 54 to the bottom end 56 of the shaft 12, or could extend a length 64 as little as 2 inches.

Figure 7:
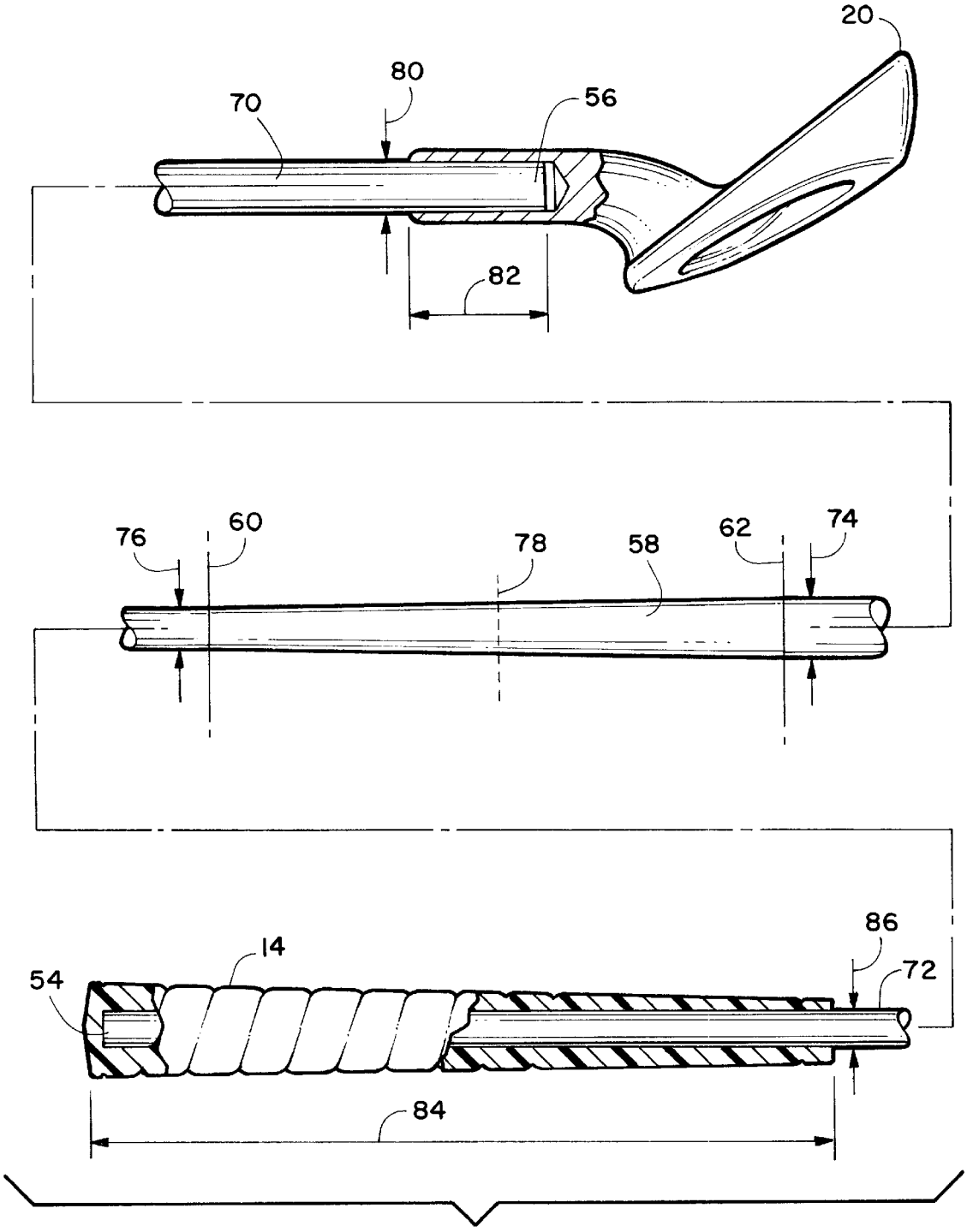
FIG. 7 is a side view of the present invention showing the dimensions of various components of the golf club and particularly illustrating the variation of diameter and length in the golf club shaft.

In the preferred embodiment as shown in FIG. 7, the shaft 12 has, in adjacent order from the top end 54 of the golf club 10 to the bottom end 56, a first constant diameter portion 72, a intermediate taper portion 58, and a second constant diameter portion 70. The diameter of the shaft 12 at the first location 60 is a first diameter 76 and the diameter of the shaft 12 at the second location 62 is a second diameter 74. The diameter of the shaft 12 varies between the first diameter 76 and the second diameter 74 depending upon the height of the user and his or her estimated swing speed.

The golf club 10 of the present invention is fitted for a user by measuring the user from the top knuckle of the hand to the ground. For users having a height of 26 inches or less, the present invention contemplates a gradual and consistent taper which increases in diameter from a first diameter 76 of 8.7 mm at a first location 60 which is approximately 5 inches from the bottom end 56 of the shaft to a second diameter 74 of 9.2 mm which is approximately 2 inches from the bottom end 56 of the shaft. Similarly, the golf club 10 of the present invention fitted for a user having a height of between 26 and 30 inches as mentioned above contemplates a gradual and consistent taper which decreases in diameter from a first diameter 76 of 9.9 mm at a first location 60 which is 17.25 mm from the bottom end 56 of the shaft to a second diameter 74 of 9.2 mm at the bottom end 56 of the shaft 12. As preferred, acceptable strength to flex ratios results with a shaft diameter which does not exceed 11 mm.

The flex point 78 is another variable which determines shaft flex and may be located on the shaft either closer or further from the top end 54 than the bottom end 56. The location of the flex point 78 is calibrated to fit the typical swing speed of the golfer and is primarily based upon the location and diameters 74, 76 and the length of the taper portion 58.

The club head 20, having a standard core diameter which is slightly larger than diameter 80, is positioned over a portion 82 of the bottom end 56 of shaft 12.

The hand grip 14, having a length 84 and an assembled core diameter 86, is positioned over a portion of the top end 54 of shaft 12. Since the diameter of the shaft is relatively small, the hand grip 14 of the present invention is specially designed with a pre-assembled core diameter of approximately 0.335 thousandths of an inch to properly fit the shaft without using underpinnings, such as wood or excess two sided grip tape.

The present invention also pertains to a method of calibrating a golf club for a user having a swing speed of 60 mph or less. The first step in the method includes the step of providing a strong yet flexible cylindrical shaft material such as solid core fiberglass. This step is followed by the step of determining the length of the shaft which is a proportional relationship to the measured height of the user. The next step includes selecting the particular diameter variation and length of a taper portion located intermediate the first and second ends of the shaft based in part upon the relative club head swing speed of the user. The method continues with the step of connecting a head for striking a golf ball to the bottom end of the shaft and attaching a hand grip to the top end of the shaft, the hand grip having a short and long shot hand grip designation respectively.

It will therefore be understood that various changes in the details, materials and arrangement of parts which have been herein described and illustrated in order to explain the nature of the invention may be made by those skilled in the art within the principal and scope of the invention as expressed in the following claims.

I claim:

1. A multi-use golf club which allows a user to select the desired travel distance of a golf ball, comprising:

a shaft having a first and second end;

a head for striking the golf ball, said head connected to said first end of said shaft and having a striking face of fixed loft; and a hand grip connected to aid second end of said shaft, said hand grip having first and second visible hand grip position designations located the eon spaced apart from one another along said hand grip a distance of 1 to 3 inches, said head having a first and second club number designation located thereon, wherein said first club number designation defines a first set of characteristics and said second club number designation defines a second set of characteristics, wherein said first set of characteristics is exhibited when the user's grip is positioned adjacent said first hand grip designation, and said second set of characteristics is exhibited when the user's grip is positioned adjacent said second hand grip designation.

2. A multi-use golf club, as in claim 1, in which said shaft is constructed of flexible solid-core glass fibers, said shaft having a taper portion located intermediate said first and second ends of said shaft, said taper portion beginning at a first location on said shaft and ending at a second location on said shaft, wherein the diameter of said shaft at said first location is a first diameter, and the diameter of said shaft at said second location is a second diameter, and wherein the relative length of said taper portion and the relative position of said first and second locations on said shaft being determined in part by the relative swing speed of the user, said taper portion increasingly varies in diameter from said first diameter to said second diameter, the diameter of said shaft ranging between 8 and 11 mm.

3. A multi-use golf club as recited in claim 2, wherein said hand grip is formed with a core diameter of approximately 0.335 of an inch.

4. A multi-use golf club as in claim 1, in which a plurality of such golf clubs are provided in a set, each club in the set having shaft length, striking head loft, and club member designations, all differing from those of the other clubs in the set.

5. A multi-use golf club as in claim 1, in which the length of the shaft ranges between 22 to 33 inches.

* * * * *

UNITED STATES PATENT AND TRADEMARK OFFICE
CERTIFICATE OF CORRECTION

PATENT NO. : 5,865,684

DATED : February 2, 1999

INVENTOR(S) : Paul J. Herber

It is certified that error appears in the above-identified patent and that said Letters Patent is hereby corrected as shown below:

Column 8, claim 1, line 14, delete "aid" and insert --said--; line 16, delete "the eon" and insert --thereon--.

Signed and Sealed this

Twenty-fifth Day of May, 1999

*Attest:*

Q. TODD DICKINSON

*Attesting Officer*

*Acting Commissioner of Patents and Trademarks*